US011187195B2

(12) United States Patent
Kase

(10) Patent No.: US 11,187,195 B2
(45) Date of Patent: Nov. 30, 2021

(54) ENGINE GENERATOR

(71) Applicant: HONDA MOTOR CO., LTD., Tokyo (JP)

(72) Inventor: Takuo Kase, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/757,584

(22) PCT Filed: Aug. 3, 2018

(86) PCT No.: PCT/JP2018/029213
§ 371 (c)(1),
(2) Date: Apr. 20, 2020

(87) PCT Pub. No.: WO2019/123707
PCT Pub. Date: Jun. 27, 2019

(65) Prior Publication Data

US 2021/0199073 A1 Jul. 1, 2021

(30) Foreign Application Priority Data

Dec. 19, 2017 (JP) ..... JP2017-243061

(51) Int. Cl.
*F02M 25/08* (2006.01)
*F02B 63/04* (2006.01)
*F02M 37/00* (2006.01)

(52) U.S. Cl.
CPC ..... *F02M 25/0872* (2013.01); *F02B 63/04* (2013.01); *F02M 37/0076* (2013.01)

(58) Field of Classification Search
CPC .... B60K 15/03006; B60K 2015/03144; B60K 15/03; B60K 15/0351; B60K 2015/03296;
(Continued)

(56) References Cited

U.S. PATENT DOCUMENTS 4,457,443 A * 7/1984 Casimir ..... B60K 15/03504 220/500
6,302,137 B1 * 10/2001 Devall ..... B60K 15/035 137/202

(Continued)

FOREIGN PATENT DOCUMENTS

CN 101294527 A 10/2008
CN 201810404 U 4/2011

(Continued)

OTHER PUBLICATIONS

International Search Report, dated Oct. 16, 2018, 2 pages.

(Continued)

*Primary Examiner* — George C Jin
*Assistant Examiner* — Teuta B Holbrook
(74) *Attorney, Agent, or Firm* — Rankin, Hill & Clark LLP

(57) ABSTRACT

An engine generator including, in a housing: a generator; an engine; a fuel tank; a canister for collecting evaporated fuel; and pipes for causing the canister and an inside of the fuel tank to communicate with each other. The pipes include the pipe section provided in the fuel tank; the pipe section extends above a liquid surface of the fuel in the fuel tank in a state in which a short-length side of the housing is placed downward; and the pipe section includes a portion that passes through a place above the liquid surface of the fuel in a state in which an opposite side of the housing is placed downward.

4 Claims, 6 Drawing Sheets

(58) Field of Classification Search
CPC ..... B60K 2015/03566; B60K 28/10; B60K 6/24; F02M 25/089; F02M 25/08; F02M 25/0854; F02M 25/0872; F02B 63/04
USPC ..... 123/518, 519
See application file for complete search history.

(56) References Cited

U.S. PATENT DOCUMENTS 7,104,258 B2 * 9/2006 Yamada ..... F02M 9/02 123/516
8,178,985 B2 * 5/2012 Hirose ..... F02B 63/04 290/1 A
9,453,583 B1 * 9/2016 Boucher, II ..... F16K 24/046
2008/0178851 A1 * 7/2008 Makino ..... F02M 33/08 123/520
2008/0264391 A1 * 10/2008 Yamamoto ..... F02D 29/06 123/519
2009/0236350 A1 * 9/2009 Miura ..... B60K 15/03519 220/745
2012/0152210 A1 * 6/2012 Reddy ..... F02M 25/089 123/520
2014/0026828 A1 * 1/2014 Kojima ..... F02B 63/04 123/2
2019/0323424 A1 * 10/2019 Markoski ..... F02B 5/00

FOREIGN PATENT DOCUMENTS

CN 202707294 U 1/2013
CN 203441640 U 2/2014
JP H07-034985 2/1995

OTHER PUBLICATIONS

Written Opinion of the International Searching Authority dated Oct. 16, 2018 filed in PCT/JP2018/029213, 3 pages.
International Preliminary Report on Patentability dated Jul. 2, 2020, 6 pages.
Chinese Office Action dated Jun. 29, 2021, 7 pages.

* cited by examiner

ENGINE GENERATOR

TECHNICAL FIELD

The present invention relates to an engine generator and particularly to a protection structure of a canister in the engine generator.

BACKGROUND ART

In an engine generator, an engine, a generator, a muffler, an inverter, and the like are accommodated in a housing so as to reduce sound at time of operation and to protect the engine, the generator, the muffler, the inverter, and the like. The engine generator is desired to be lightweight and compact so as to be easily carried by being held by hand.

A canister that prevents an outflow of gasoline due to evaporation is connected to a fuel tank of the engine generator. A gas phase section in the fuel tank and the canister are connected to each other by a pipe, and volatilized gasoline is adsorbed by an activated carbon in the canister, to thereby prevent the outflow.

As described in Patent Literature 1, a configuration in which an adsorbent is accommodated in a lid of a fuel tank is known.

CITATION LIST

Patent Literature

Patent Literature 1

Japanese Patent Laid-Open No. 7-34985

SUMMARY OF INVENTION

Technical Problem

However, in the configuration described in Patent Literature 1, the canister is provided in the lid of the fuel tank, and hence the capacity of the canister is limited, and it is difficult to improve the ability of collecting fuel by increasing the capacity of the canister.

Thus, a canister having a large capacity and connected to the fuel tank by a pipe is used more often than a simple canister provided in the lid of the fuel tank.

However, if the canister is connected to the fuel tank by a pipe, there is a fear that a large amount of fuel may flow into the canister through the pipe when the engine generator falls down.

In view of the abovementioned disadvantages of the related art, an object of an aspect of the present invention is to provide an engine generator that uses a canister with a large capacity and blocks excessive flow of fuel into the canister.

Solution to Problem

The entirety of Japanese Patent Application No. 2017-243061 filed on Dec. 19, 2017 is incorporated herein.

According to an aspect of the present invention, there is provided an engine generator including, in a housing: a generator; an engine for driving the generator; a fuel tank for storing fuel to be supplied to the engine; a canister for collecting the fuel evaporated in the fuel tank; and a pipe for causing the canister and an inside of the fuel tank to communicate with each other. In the engine generator, the pipe includes a pipe section provided in the fuel tank, the pipe section extends above a liquid surface of the fuel in the fuel tank in a state in which one side surface of the housing on a short-length side of the housing is placed downward, and the pipe section includes a portion that passes through a place above the liquid surface of the fuel in the fuel tank in a state in which an other side surface of the housing on the short-length side of the housing is placed downward.

According to an aspect of the present invention, the pipe for causing the canister and the inside of the fuel tank to communicate with each other may have an on-off valve provided in the pipe.

According to an aspect of the present invention, the on-off valve may be in coordination with an operating portion for turning the engine on and off.

According to an aspect of the present invention, the on-off valve and the operating portion may be coaxially located and be integrally provided.

Advantageous Effects of Invention

According to the engine generator according to an aspect of the present invention, a part of the pipe extends above the liquid surface of the fuel in the fuel tank by the pipe layout, and hence the infiltration of the fuel to the canister can be prevented, and a mechanism for preventing the infiltration of the fuel to the canister with excellent sustainability can be obtained.

The space in the fuel tank can be used, and hence the space in the housing can be effectively used, and the capacity of the fuel tank can be increased.

A canister with a large capacity can be employed in the engine generator.

In an aspect of the invention, the pipe for causing the canister and the inside of the fuel tank to communicate with each other may have the on-off valve provided in the pipe.

According to the configuration, a configuration for preventing the infiltration of the fuel to the canister can be dually provided and the infiltration of the fuel to the canister can be reliably prevented.

In an aspect of the invention, the on-off valve may be in coordination with the operating portion for turning the engine on and off.

According to the configuration, when the engine generator is stopped or in a stored state, the infiltration of the fuel to the canister can be prevented. The on-off valve is closed by the operation of stopping the engine generator, and hence a case where the on-off valve is forgotten to be closed does not occur. A case where the on-off valve is forgotten to be opened can also be prevented when the engine generator is started.

In an aspect of the invention, the on-off valve and the operating portion may be coaxially located and be integrally provided.

According to the configuration, a mechanism including the on-off valve and the operating portion can be caused to be compact. As a result, a link and the like that cause the on-off valve and the operating portion to operate in coordination with each other is unnecessary, and the on-off valve in coordination with the operating portion can be provided with a minimum weight. Increase of an operation load of the operating portion due to the operation of the on-off valve can be suppressed. The on-off valve is directly operated by the operating portion, and hence the reliability in the operation of the on-off valve is increased.

DESCRIPTION OF EMBODIMENT

[Overall Configuration]

The present invention is described in detail below with reference to the drawings.

Figure 1:
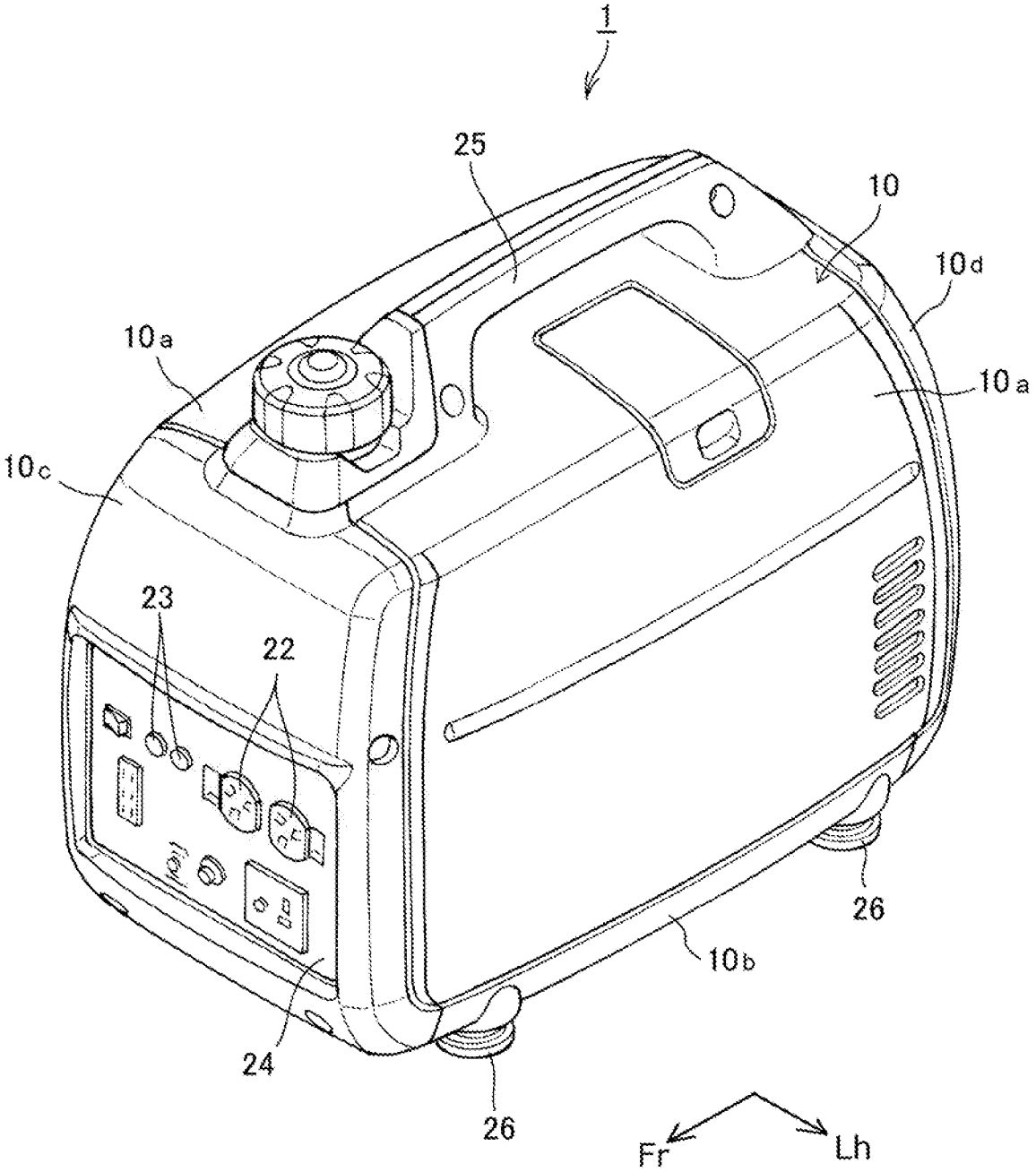
FIG. 1 is a front perspective view of an engine generator.

First, an external appearance of an engine generator 1 is described with reference to FIG. 1. Note that, in FIG. 1, Fr indicates a front side and Lh indicates a left side.

A length of the engine generator 1 in a front-rear direction is longer than a width of the engine generator 1 in a left-right direction. The front-rear direction of the engine generator 1 is a longitudinal direction, and the left-right direction of the engine generator 1 is a short-length direction.

The engine generator 1 includes an engine (not shown) and a generator (not shown) in a cover 10 that is a housing of the engine generator 1. Electric power is generated by driving the generator by the engine. As illustrated in FIG. 1, a control panel 24 is provided on a front surface of the engine generator 1. On the control panel 24, an output terminal 22, an indication lamp 23, switches, and the like are provided. The electric power from the engine generator 1 is output from the output terminal 22, and an operation state of the engine generator 1 is recognized by the indication lamp 23.

On an upper portion of the engine generator 1, a grip 25 is provided. The engine generator 1 can be easily carried around by the grip 25.

The cover 10 is formed by side covers 10*a* that cover side surfaces of the engine generator 1, a front cover 10*c* that covers a front surface of the engine generator 1, a rear cover 10*d* that covers a rear surface of the engine generator 1, and an under cover 10*b* that covers a lower portion of the engine generator 1.

On the under cover 10*b*, a plurality of legs 26 for mounting are provided. The engine generator 1 generates power in a state in which the legs 26 are mounted on a ground surface and the like.

Figure 2:
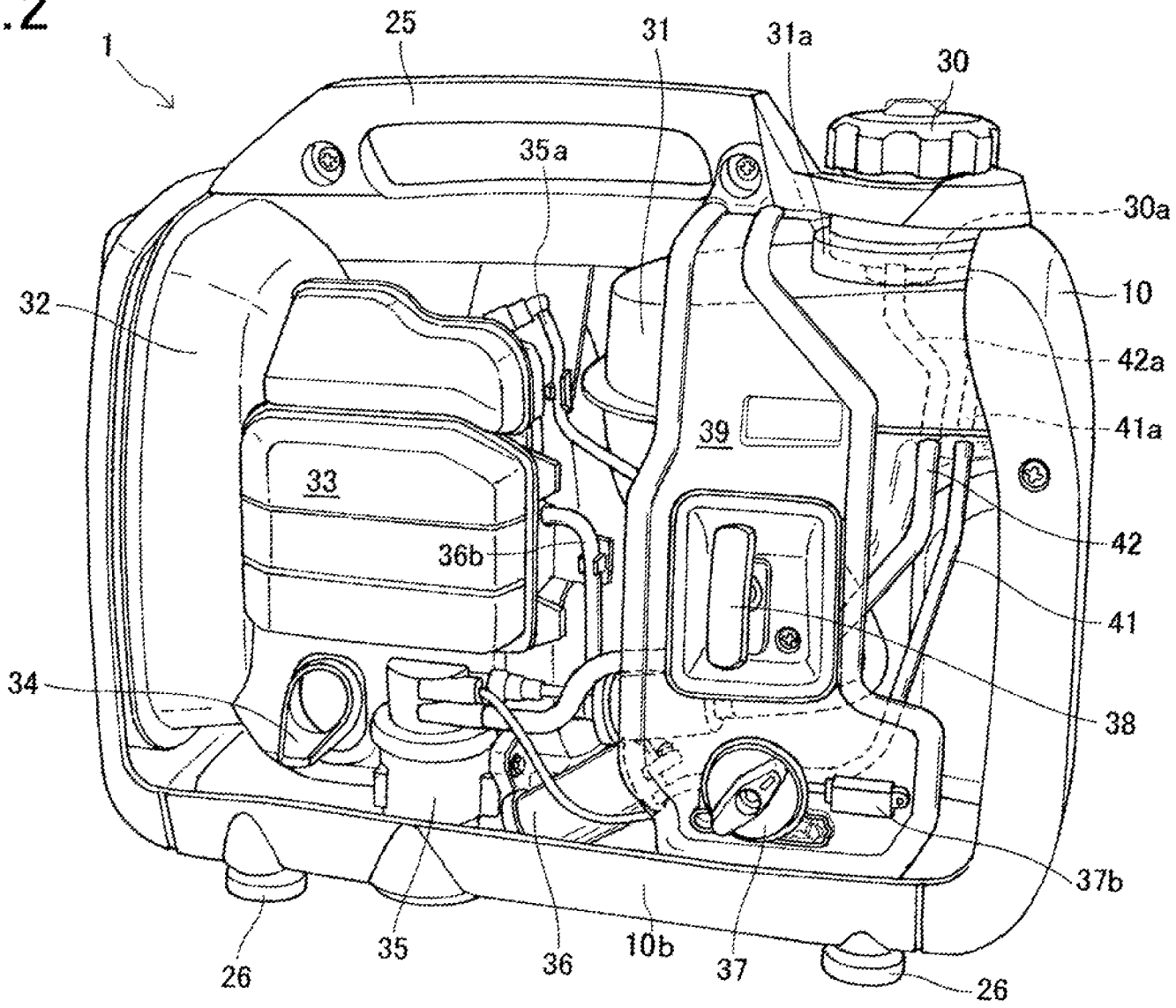
FIG. 2 is a side perspective view illustrating an inner configuration of the engine generator.

Next, an inner portion of the engine generator 1 is described with reference to FIG. 2.

A fuel tank 31 that stores fuel in the fuel tank 31 is provided in a front portion of the engine generator 1. An air cleaner case 33 is provided on a rear side of the fuel tank 31 and in a right side portion of the engine generator 1. An engine oil feeding port 34 is provided on a lower side of the air cleaner case 33.

A partition wall 32 is provided in a rear portion of the engine generator 1, and a muffler disposing space is divided by the partition wall 32 in the engine generator 1.

The engine and the generator (not shown) are disposed between the fuel tank 31 and the partition wall 32. A fan (not shown) is driven by the engine, and cooling air is generated in the engine generator 1.

A canister 36 is disposed in a right side portion of a lower portion of the engine generator 1. Fuel such as gasoline that has evaporated in the fuel tank 31 is adsorbed in the canister 36. The canister 36 is connected to the fuel tank 31 by a charging line 41, and is connected to the air cleaner case 33 by a hose 36*b*. As a result, the fuel and the like adsorbed in the canister 36 is discharged into the air cleaner case 33 when the engine generator 1 operates.

A fuel injection pump 35 is disposed in the right side portion of the lower portion of the engine generator 1 and on a rear side of the canister 36. The fuel injection pump 35 is connected to the fuel tank 31 by a fuel pipe 43. A fuel injection valve (not shown) is connected to the fuel injection pump 35 via a high-pressure pipe 35*a*.

A return hose 42 is connected to the fuel injection pump 35. By the return hose 42, fuel is returned to the fuel tank 31 from the fuel injection pump 35.

[Fuel Tank]

A protruding portion 31*a* protruding upward in a cylindrical shape is provided on an upper portion of the fuel tank 31, and a filler pipe 30*a* is installed on the protruding portion 31*a*. An inner diameter of the protruding portion 31*a* is larger than an outer diameter of the filler pipe 30*a*, and a space is formed on a side of a lower portion of the filler pipe 30*a* in the fuel tank 31.

An oil supply cap 30 is installed on an upper portion of the filler pipe 30*a*. On an inner peripheral surface of the filler pipe 30*a*, a line indicating an oil supply limit that is an upper limit of a fuel injection amount is displayed.

The charging line 41 of the canister 36 is connected to an upper charging line 41*a* in the fuel tank 31. The upper charging line 41*a* is provided in the fuel tank 31, and an upper end of the upper charging line 41*a* is located between the protruding portion 31*a* and the filler pipe 30*a*.

The return hose 42 is connected to an upper return hose 42*a* in the fuel tank 31. The upper return hose 42*a* is provided in the fuel tank 31, and an upper end of the upper return hose 42*a* is also located between the protruding portion 31*a* of the fuel tank 31 and the filler pipe 30*a*.

[Switch Knob]

In a right side portion of the engine generator 1 on a front side of the engine generator 1, a subframe 39 is provided from the under cover 10*b* of the engine generator 1 to the grip 25. A starter grip 38 connected to the recoil starter is held by the subframe 39. In the subframe 39, a switch knob 37 is provided below the starter grip 38.

The switch knob 37 is an operating portion for turning the engine on and off.

The switch knob 37 is a rotary type, and can be switched between an "ON" position and "OFF" position. When the engine generator 1 is to be started, the switch knob 37 is turned to the "ON" position and the engine of the engine generator 1 is started by the starter grip 38. When the engine generator 1 is to be stopped, the switch knob 37 is turned to the "OFF" position.

In other words, the switch knob 37 is in the "ON" position when the engine generator 1 is in the operation state or an operation starting state, and the switch knob 37 is in the "OFF" position when the engine generator 1 is in a stop state.

A switch 37*b* is provided near the switch knob 37. The switch 37*b* is placed in an "ON" state when the switch knob 37 is in the "ON" position, and the switch 37*b* is placed in an "OFF" state when the switch knob 37 is in the "OFF" position. By the switch 37*b*, the positions of "ON" and "OFF" of the switch knob 37 can be recognized.

Both of the switch knob 37 and the switch 37*b* are mounted on the subframe 39, and the switching of the switch 37*b* between "ON" and "OFF" can be reliably performed by the operation of the switch knob 37.

[Pipes in Fuel Tank]

Figure 3:
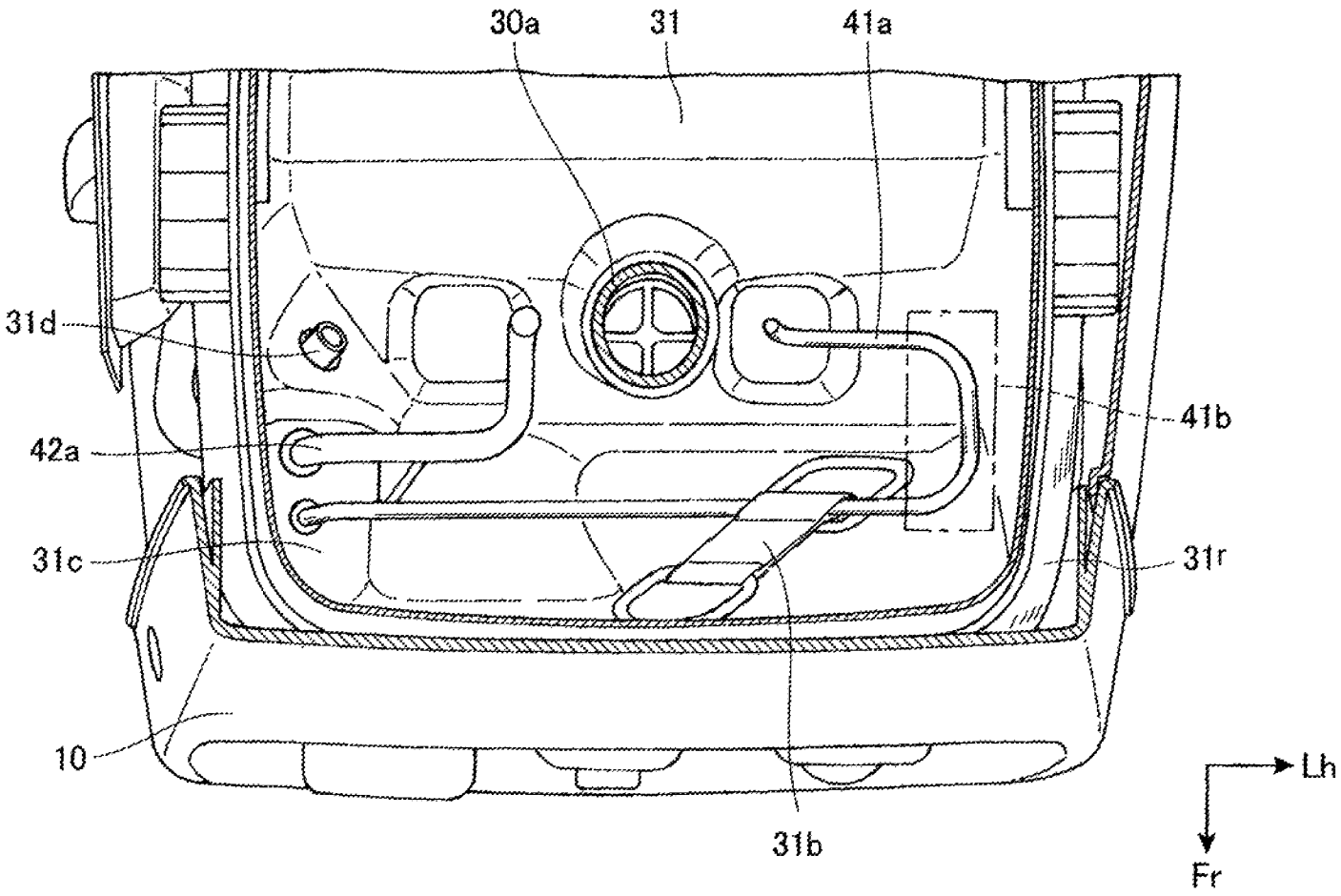
FIG. 3 is a plan partial cross-sectional view illustrating a configuration in a tank.

Next, a pipe structure in the fuel tank 31 is described with reference to FIG. 3.

The fuel tank 31 has an upper portion and a lower portion that are formed by press-molding metal thin plates, and is formed by welding those portions.

Therefore, a joining peripheral portion 31*r* is provided in a central portion of the fuel tank 31 in an up-down direction. The upper portion and the lower portion of the fuel tank 31 are joined at the joining peripheral portion 31*r*, and have shapes protruding to the front, rear, left, and right at the joining peripheral portion 31*r*.

In a bottom portion in the fuel tank 31, a fuel supply port 31*e* connected to the fuel pipe 43 is provided. Fuel is supplied to the fuel injection pump 35 via the fuel supply port 31*e*.

A joint forming portion 31*c* is provided on a central portion of the fuel tank 31 in the up-down direction and on a right side portion of the fuel tank 31. The joint forming portion 31*c* is provided in a position that is substantially in the same height as the joining peripheral portion 31*r*, and is provided in a front portion of the fuel tank 31 so as to be adjacent to the joining peripheral portion 31*r*.

A lower end of the upper return hose 42*a* and a lower end of the upper charging line 41*a* are attached to a part of the joint forming portion 31*c* that is on an inner side of the fuel tank 31.

The upper return hose 42*a* extends from the joint forming portion 31*c* to the upper portion of the fuel tank 31. An upper end of the upper return hose 42*a* is located between the protruding portion 31*a* and the filler pipe 30*a* in the fuel tank 31.

The upper charging line 41*a* extends to the upper portion of the fuel tank 31 from the joint forming portion 31*c* via a left side (a side opposite to the joint forming portion 31*c*) of the fuel tank 31.

The upper charging line 41*a* is fixed to a stay 31*b* provided on a central portion of the fuel tank 31 in the left-right direction. As a result, the upper charging line 41*a* has a laid-down J-shape in plan view.

In other words, the upper charging line 41*a* has a configuration that extends from one side of an outer side portion of the fuel tank 31 to another side, forms a folded portion 41*b* on the other side, and returns to a place near the filler pipe 30*a* provided in the central portion in the fuel tank 31. In the fuel tank 31, the folded portion 41*b* is provided in the upper charging line 41*a*, and a U-shaped portion is provided in the pipe shape.

The joint forming portion 31*c* is provided so as to be adjacent to the joining peripheral portion 31*r* of the fuel tank 31, and hence the molding of the fuel tank 31 is easy. In the fuel tank 31, a connecting portion of the upper charging line 41*a* can be provided on the outer side portion of the fuel tank 31.

Next, prevention of infiltration of the fuel to the canister 36 by the disposing shape of the pipe of the upper charging line 41*a* is described with reference to FIG. 4.

The upper charging line 41*a* is a pipe section provided in the fuel tank 31.

Figure 4:
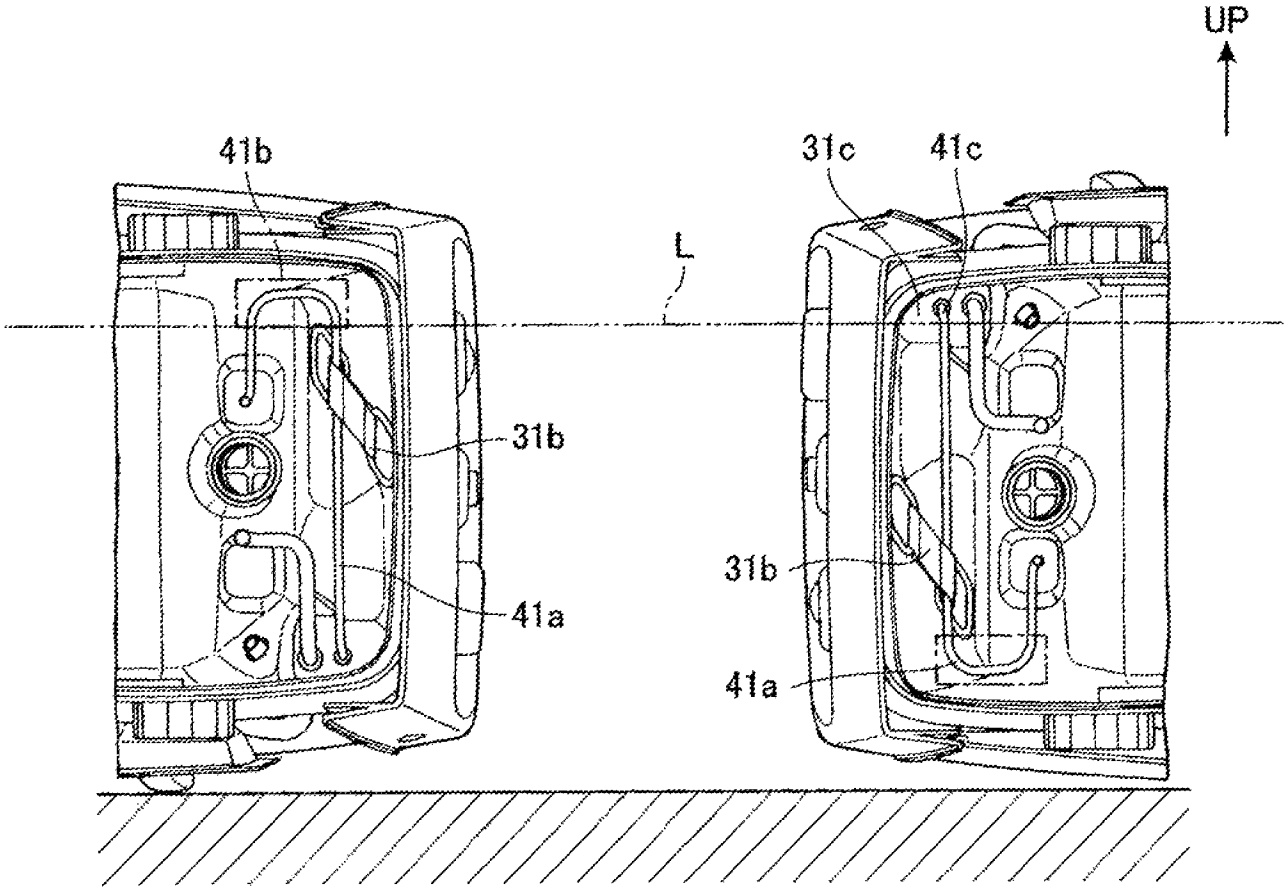
FIG. 4 illustrates a configuration of a liquid surface of fuel at time of a fall and a pipe of an evaporator.

In FIG. 4, a state in which a left side surface of the engine generator 1 is placed upward is illustrated on the left side, and a state in which a right side surface of the engine generator 1 is placed upward is illustrated on the right side.

In other words, in FIG. 4, states in which the engine generator 1 is laid down in the left-right direction (short-length direction) are illustrated.

In FIG. 4, a two-dot chain line L indicates a height of a liquid surface of the fuel in the fuel tank 31 when the fuel is supplied to the fuel tank 31 to the oil supply limit and the side surface is placed upward. In other words, the two-dot chain line L indicates a highest position of the liquid surface of the fuel when the engine generator falls down to the short-length side (the right side of the left side). Note that the oil supply limit for the fuel tank 31 is indicated on the filler pipe 30*a*.

As illustrated in FIG. 4, an end portion of the upper charging line 41*a* connected to the joint forming portion 31*c* of the fuel tank 31 is located above the two-dot chain line L in a state in which the right side surface is placed upward. The folded portion 41*b* of the upper charging line 41*a* is located above the two-dot chain line L in a state in which the left side surface is placed upward.

In the upper charging line 41*a* connected to the canister 36, a section located on a side portion of the fuel tank 31 is located in a place higher than the liquid surface of the fuel when the left or the right side surface is placed upward.

In other words, when one side surface (the left or the right side surface) of the engine generator 1 is placed downward, a pipe that connects the fuel tank 31 and the canister 36 to each other is in a place, which is on the other side surface side (the right or the left side) and is higher than the liquid surface of the fuel.

As a result, even when the engine generator 1 is in a state in which a side surface is placed upward, the fuel in the fuel tank 31 does not infiltrate to the canister 36 via the upper charging line 41*a*.

In the fuel tank 31, one end of the upper charging line 41*a* is provided so as to be above the two-dot chain line L that is the liquid surface of the fuel when the engine generator 1 is laid down in the short-length direction of the engine generator 1, and the upper charging line 41*a* passes through a place above the two-dot chain line L on the opposite side.

Therefore, by the pipe layout of the upper charging line 41*a*, the infiltration of the fuel in a liquid state to the canister 36 can be suppressed while minimizing the entire length of the upper charging line 41*a*.

Note that the configuration in which the upper charging line 41*a* is disposed in left-right direction of the engine generator 1 has been described. However, the infiltration of the fuel in the liquid state can be prevented by disposing the upper charging line 41*a* diagonally across the fuel tank 31, for example, from a right front portion to a left rear portion in the fuel tank 31.

The upper charging line 41*a* is held by the stay 31*b* in the fuel tank 31, and hence a case where the configuration of the pipe changes by coming into contact with an obstacle and the like does not occur. The inside of the fuel tank 31 is used instead of a place above the fuel tank 31, and hence a space in the upper portion of the fuel tank 31 can be effectively used.

For example, when the upper charging line 41*a* is extended from an upper surface of the fuel tank 31 to the filler pipe 30*a*, a space for the pipe is necessary between the upper surface of the fuel tank 31 and an inner surface of the cover 10.

However, by providing the upper charging line 41*a* in the fuel tank 31, the space necessary for the pipe can be used as the space for the fuel tank 31.

Figure 5:
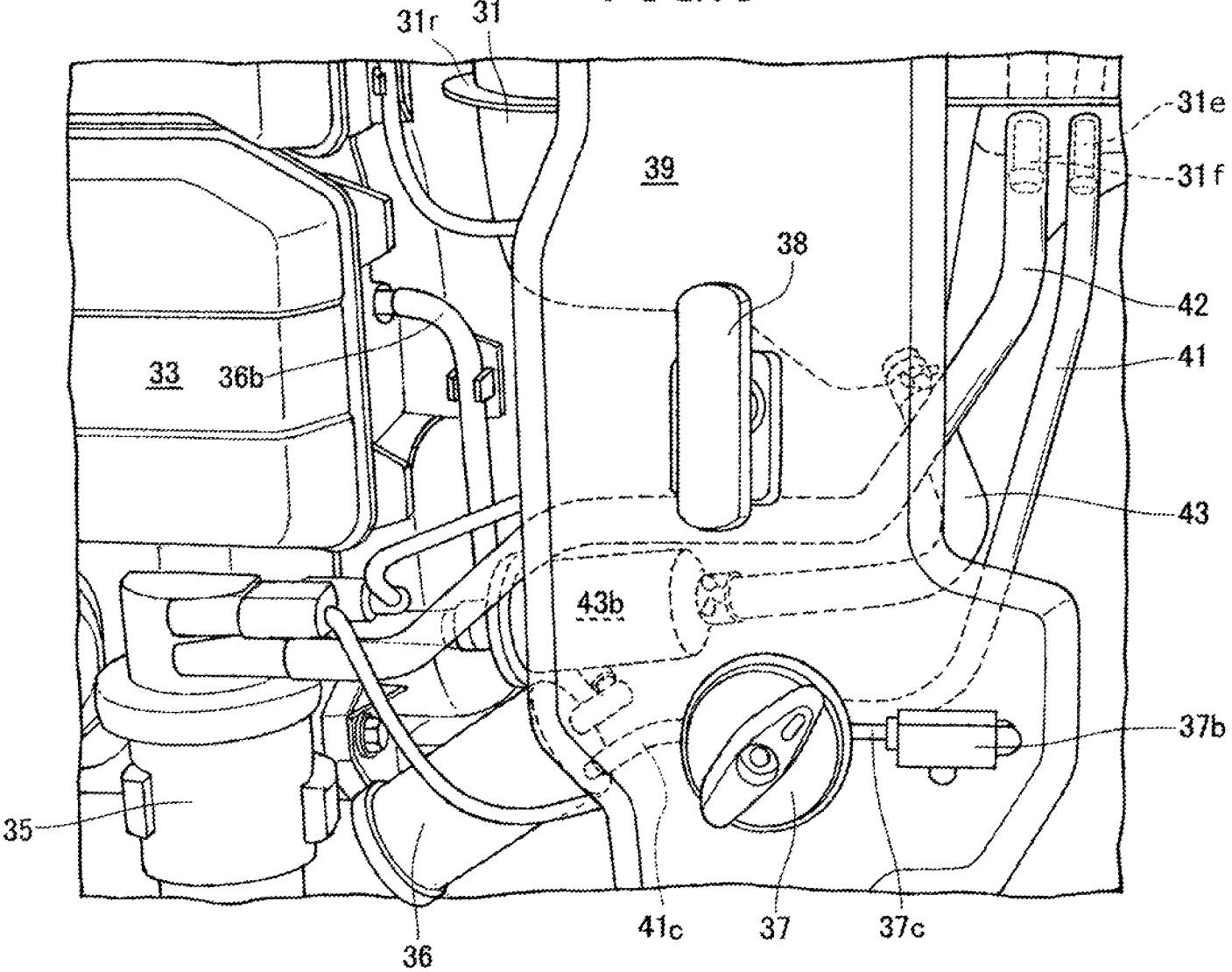
FIG. 5 illustrates a configuration around a subframe of the engine generator.

Next, a plurality of pipes connected to the fuel tank 31 are described with reference to FIG. 5.

An outer side surface of the fuel tank 31 faces downward at a section that forms the joint forming portion 31*c*. In the joint forming portion 31*c*, a joint 31*d* and a joint 31*f* extend downward. An upper end of the charging line 41 and an upper end of the return hose 42 are connected to the joint 31*d* and the joint 31*f*.

A lower end side of the charging line 41 is connected to the canister 36 via a valve 50 described below that is integrally formed with the switch knob 37, and a hose 41*c*. As a result, fuel evaporated in the fuel tank 31 can be collected by the canister 36. In other words, a pipe that causes the canister 36 and the inside of the fuel tank 31 to communicate with each other is formed by the upper charging line 41*a*, the charging line 41, and the hose 41*c*.

The return hose 42 is connected to the fuel injection pump 35. The fuel pipe 43 is connected to the fuel injection pump 35 via a strainer 43*b*. As a result, excessive fuel in the fuel injection pump 35 can be returned to the fuel tank 31.

[Valve for Canister]

Figure 6:
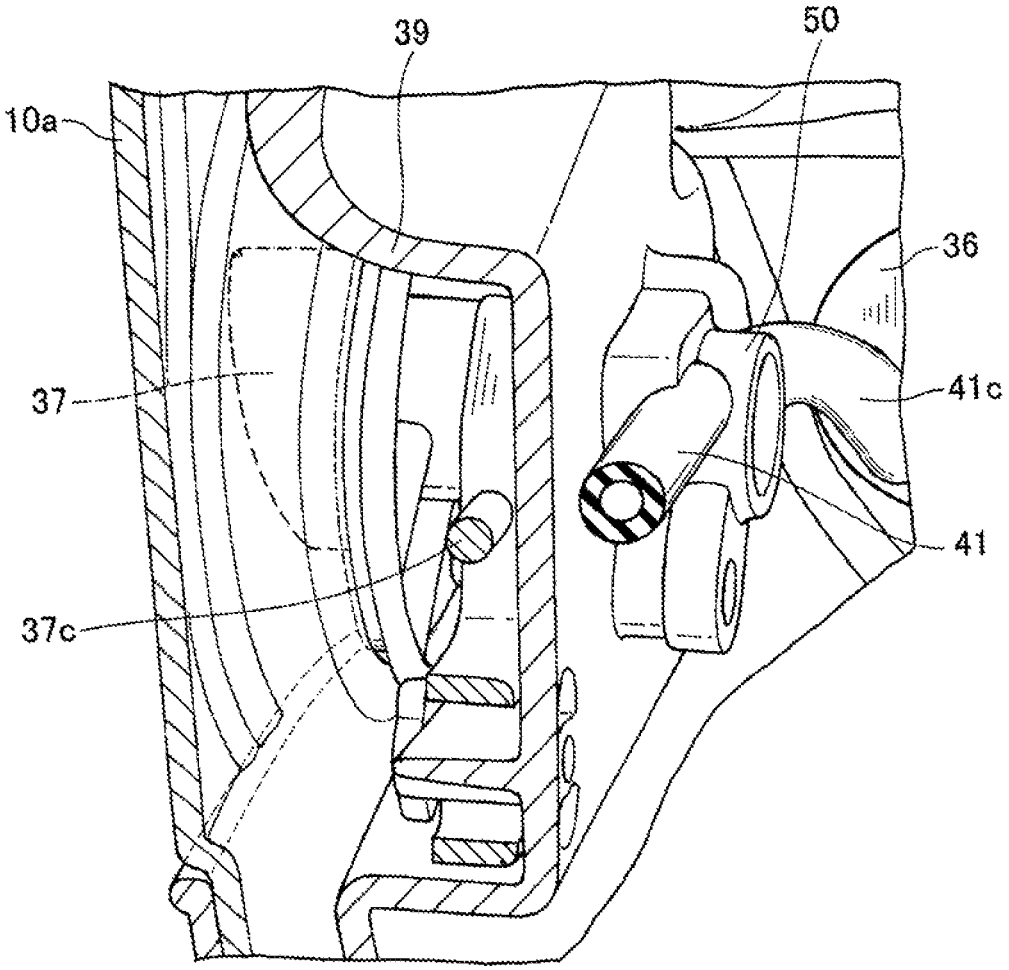
FIG. 6 illustrates a configuration around a switch knob.

Next, the valve 50 for the canister 36 that opens and closes a path between the fuel tank 31 and the canister 36 is described with reference to FIG. 5 and FIG. 6.

The valve 50 is an on-off valve, and is a valve that opens and closes by a rotary operation of a ball valve and the like. As the valve 50, a valve commonly used as a fuel valve can be used.

The starter grip 38, the switch knob 37, and the switch 37*b* are held on an outer side surface of the subframe 39 that is a surface that faces the outside of the engine generator 1 in an exposed manner. Note that the starter grip 38 and the switch knob 37 are exposed be on the outside of the engine generator 1 than the cover 10, and the switch 37*b* is held between the subframe 39 and the cover 10.

As a result, the switch 37*b* can be disposed in a place in the engine generator 1 that is not easily affected. The switch 37*b* is disposed on the subframe 39 together with the switch knob 37, and hence reliability of a response of the switch 37*b* with respect to the switch knob 37 can be improved.

The valve 50 is provided in an exposed manner on an inner side surface of the subframe 39 that is a surface facing the inside of the engine generator 1.

The valve 50 is fixed to the inner side surface of the subframe 39, and is integrally provided with the switch knob 37. The valve 50 is a rotary on-off valve, and has the same center of rotation as a rotation center of the switch knob 37. The valve 50 is connected to an end portion of the switch knob 37 inserted in the subframe 39, and opens and closes the path to the canister 36 in coordination with an operation of the switch knob 37.

When the switch knob 37 is in the "ON" position, the valve 50 opens the path connecting the charging line 41 and the canister 36 to each other. When the switch knob 37 is in the "OFF" position, the valve 50 closes the path connecting the charging line 41 and the canister 36 to each other.

The switch knob 37 and the valve 50 are coaxially provided and integrally rotate. Therefore, the valve 50 can be operated without using a linkage mechanism and the like. A rotary axis of the switch knob 37 and a rotary axis of the valve 50 are coaxially provided. As a result, the rotary operation of the valve 50 can be performed by the rotary operation of the switch knob 37.

In other words, when the switch knob 37 is in the "ON" position, the engine generator 1 is in an operating state or an operable state, and the path of the charging line 41 to the canister 36 is opened.

When the switch knob 37 is in the "OFF" position, the engine generator 1 is in a stop state, and the path of the charging line 41 to the canister 36 is closed.

By the switch knob 37, ON/OFF of the engine generator 1 and the opening and closing of the communication between the fuel tank 31 and the canister 36 are performed. As a result, the number of parts can be reduced and the weight of the engine generator 1 can be reduced as compared to a case where the operations are performed by different members. The load according to the operations can be reduced, and the operation of the switch knob 37 can be easily and smoothly performed as compared to a case where the operations are performed by different members.

As described above, the valve 50 is opened and closed in coordination with the operation of the switch knob 37, and can reliably open and close the path between the fuel tank 31 and the canister 36 in accordance with the operation state of the engine generator 1.

As a result, when the switch knob 37 is in the "OFF" position, the flow of the fuel to the canister 36 is blocked even if the fuel flows into the charging line 41 from the fuel tank 31.

The subframe 39 is connected to the cover of the lower portion on which the engine and the generator of the engine generator 1 are mounted and the grip 25 used when the engine generator 1 is lifted up. In the engine generator 1, the subframe 39 has end portions in the up-down direction that are connected to highly-rigid members, and hence the subframe 39 itself is not easily deformed.

The valve 50 that opens and closes the path to the canister 36 is provided on the subframe 39 as above, and hence relative positions of the fuel tank 31 and the valve 50 do not easily change, and the charging line 41 is not easily affected when the engine generator 1 receives an impact.

The canister 36 is mounted on the lower portion of the engine generator 1. The strainer 43*b* is also mounted on the subframe 39, and the fuel injection pump 35 is also mounted on the lower portion of the engine generator 1.

The joint 31*f* is provided on a lower surface of the fuel tank 31, and the valve 50 is provided below the joint 31*f*. The valve 50 is provided between the joint 31*f* to which the charging line 41 is connected and the canister 36. Therefore, the charging line 41 does not necessarily need to be largely bent, and the length of the charging line 41 can be reduced. A space under the fuel tank 31 can be efficiently used.

As described above, the infiltration of the fuel to the canister 36 is prevented by the shape of the upper charging line 41*a* disposed in the fuel tank 31 and the valve 50 provided between the fuel tank 31 and the canister 36.

Even when the engine generator 1 falls down in a state in which the fuel is provided to the oil supply limit, the infiltration of the fuel to the canister 36 does not easily occur due to the shape of the upper charging line 41*a*. Even when the engine generator 1 falls down during transportation, the outflow of the fuel can be prevented by the valve 50.

The abovementioned embodiment merely describes one aspect of the present invention, and any modification and application can be made without departing from the gist of the present invention.

In the abovementioned embodiment, an example of a mobile engine generator has been described as the engine generator, but the present invention is not limited to the mobile engine generator and can be applied to an engine generator including a canister connected to a fuel tank by a pipe.

REFERENCE SIGNS LIST

1 Engine generator
10 Cover

31 Fuel tank
36 Canister
37 Switch knob
39 Subframe
41 Charging line
41*a* Upper portion charging line
41*b* Folded portion
41*c* Hose
50 Valve

The invention claimed is:

1. An engine generator comprising, in a housing that comprises side covers that cover both side surfaces of the engine generator, a front cover that covers a front surface of the engine generator, a rear cover that covers a rear surface of the engine generator, and an under cover that covers a bottom portion of the engine generator:

a fuel tank for storing fuel to be supplied to an engine for driving a generator;

a canister for collecting the fuel evaporated in the fuel tank; and a pipe for causing the canister and an inside of the fuel tank to communicate with each other, wherein, in a state in which the bottom portion of the housing is placed downward, a front-rear direction of the housing is a longitudinal direction, and a left-right direction of the housing is a short-length direction, the fuel tank is provided in a front portion of the housing, the canister is provided in the bottom portion of the housing, a joint forming portion, to which the pipe is connected, is provided in a front portion of the fuel tank, on a central portion of the fuel tank in an up-down direction, and on one side of the fuel tank in the left-right direction, the pipe section includes:

a hose that extends outside the fuel tank from the joint forming portion and that is connected to the canister; and an upper charging line that is provided in the fuel tank and that extends to an upper portion of the fuel tank from the joint forming portion;

the upper charging line extends from the one side to an other side of the fuel tank in the left-right direction, and the upper charging line includes a folded portion, which is formed in a U-shape in a plan view, that extends from the other side of the fuel tank to a rear side of the fuel tank and returns to the one side of the fuel tank, a connected portion of the upper charging line, which is connected, in the fuel tank, to the joint forming portion, extends above the liquid surface of the fuel in a state in which fuel is supplied to the fuel tank to an oil supply limit and one side cover that is one side surface of the housing in the short-length direction is placed downward, and the folded portion of the upper charging line passes through, in the fuel tank, a place above the liquid surface of the fuel in a state in which the fuel is supplied to the fuel tank to the oil supply limit and another side cover that is at another side surface of the housing in the short-length direction is placed downward.

2. The engine generator according to claim 1, wherein the pipe for causing the canister and the inside of the fuel tank to communicate with each other has an on-off valve provided in the pipe.

3. The engine generator according to claim 2, wherein the on-off valve is in coordination with an operating portion for turning the engine on and off.

4. The engine generator according to claim 3, wherein the on-off valve and the operating portion are coaxially located and are integrally provided.

* * * * *